US008939481B1

(12) United States Patent
Qi

(10) Patent No.: US 8,939,481 B1
(45) Date of Patent: Jan. 27, 2015

(54) ANIMAL WASTE HANDLING SYSTEM

(71) Applicant: Lai Qi, Dallas, TX (US)

(72) Inventor: Lai Qi, Dallas, TX (US)

( * ) Notice: Subject to any disclaimer, the term of this patent is extended or adjusted under 35 U.S.C. 154(b) by 0 days.

(21) Appl. No.: 14/280,750

(22) Filed: May 19, 2014

(51) Int. Cl.
*A01K 29/00* (2006.01)
*E01H 1/12* (2006.01)

(52) U.S. Cl.
CPC ..... *E01H 1/1206* (2013.01); *E01H 2001/1273* (2013.01); *E01H 2001/1293* (2013.01)
USPC ..... 294/1.4

(58) Field of Classification Search
CPC ..... E01H 1/1206; E01H 2001/1273; E01H 2001/1293; A01K 23/005
USPC ..... 294/1.3, 1.4, 1.5, 214, 209, 210, 111, 294/115; 15/257.6, 257.7, 104.8
See application file for complete search history.

(56) References Cited

U.S. PATENT DOCUMENTS 3,841,686 A * 10/1974 Gallo et al. ..... 294/1.4
4,225,174 A * 9/1980 Hennessy et al. ..... 294/1.4
5,380,054 A * 1/1995 Galvis ..... 294/1.4
5,503,442 A * 4/1996 Lee ..... 294/1.4
5,868,447 A * 2/1999 Clark et al. ..... 294/1.4
6,135,520 A * 10/2000 Miller et al. ..... 294/1.4
7,204,532 B2 * 4/2007 Lefevre ..... 294/1.5
2004/0066049 A1 * 4/2004 Azrikam ..... 294/1.4
2006/0237977 A1 * 10/2006 Krieger ..... 294/1.4
2008/0136201 A1 * 6/2008 Dong ..... 294/1.3
2010/0096866 A1 * 4/2010 Flinn ..... 294/1.4
2010/0187842 A1 * 7/2010 Buzby et al. ..... 294/19.1

* cited by examiner

*Primary Examiner* — Dean Kramer
(74) *Attorney, Agent, or Firm* — Richard G. Eldredge

(57) ABSTRACT

A system for facilitating removal of an object, such as animal waste, may include an elongated shaft having a first end and a second opposing end, a handle associated with the first end, a collection device associated with the second end, an actuator associated with the handle and operably coupled to the collection device. The system may further include a latching device associated with the handle and operably coupled to the actuator. The actuator may be configured to actuate the collection device, and the collection device may be configured to facilitate collection of animal waste, while the latching device is configured to retain the collection device in a closed position. A method for removal of animal waste may include using a system for facilitating removal of animal waste.

19 Claims, 11 Drawing Sheets

ANIMAL WASTE HANDLING SYSTEM

BACKGROUND

1. Field of the Disclosure

The present disclosure relates generally to a system for facilitating removal of animal waste material and associated methods.

2. Description of Related Art

Devices to collect and dispose of animal wastes are well known. It should be understood that municipal regulations require that animal feces be removed by the owner; a process that can be rather revolting to some. As such, there exist various devices that assist the owner in the cleanup process.

According to one common method, the owner will utilize a portable shovel to dispose of the feces. This solution has significant limitations and problems, such as the burden of carrying the shovel, e.g., during a walk with the animal, and while the shovel is soiled from the animal waste. In another known method, the owner will carry a number of bags to pick up and dispose of the feces. This solution also causes problems as the user is required to come in close contact with the feces. In yet another known method, a scooping device may be used to collect the feces and place it into a bag. The scooping device may overcome some of the problems associated with merely collecting the feces with a bag or shovel; however, the scooping device may not maintain the bag in a closed condition upon receipt of the feces, which in turn results in the bag not containing the unpleasant smell.

Although great strides have been made in the area of animal waste handling devices, some shortcomings remain.

SUMMARY OF THE INVENTION

One aspects of the embodiments relate to a system for facilitating removal of an object, such as animal waste, may include an elongated shaft having a first end and a second opposing end, a handle associated with the first end, a collection device associated with the second end, an actuator associated with the handle and operably coupled to the collection device. The system may further include a latching device associated with the handle and operably coupled to the actuator. The actuator may be configured to actuate the collection device, and the collection device may be configured to facilitate collection of animal waste, while the latching device is configured to retain the collection device in a closed position. According to another aspect, the system may further include a cable coupled to the actuator and coupled to the collection device, wherein the cable extends substantially the length of the elongated shaft. The elongated shaft may also include a first shaft section removably coupled to a second shaft section. The elongated shaft may also be configured to be selectively extended and retracted telescopically. According to another aspect, the handle may include an aperture configured to receive a portion of the actuator therethrough, wherein the latching device is configured to engage with the portion of the actuator extending through the aperture. The actuator may also include a ridge configured to cooperate with the latching device to maintain the actuator in a fixed position.

In another aspect of the embodiments, the latching device may be pivotally coupled relative to the handle. The system may further include a housing coupled to the second end of the elongated shaft and to the collection device, wherein the housing is rotatable relative to the elongated shaft. According to another aspect, the collection device may include a first arm and a second arm, wherein at least one of the first arm and the second arm is configured to pivot relative to one another, and wherein the first arm is configured to convey animal waste towards the second arm. The system may further include a cable coupled to the actuator and associated with the collection device, wherein the actuator is configured to cause the at least one of the first arm and the second arm to pivot via the cable. The first arm may also include a plurality of ribs, and the second arm may define an opening. The at least one of the first arm and the second arm may also include at least one bag attachment member configured to secure a detachable bag to the collection device. The at least one bag attachment member may extend from an outer surface of the first arm. The system may further include a detachable bag, and the detachable bag may include at least one hole configured to receive the bag attachment member. The at least one bag attachment member may also include a shaft and a retainer, and wherein the at least one hole is configured to be placed over the retainer and around the shaft. The first arm may also include a plurality of attachment members, the second arm may also include a plurality of attachment members, and the detachable bag may also include a plurality of holes configured to receive at least two attachment members from each of the first arm and the second arm.

In another aspect of the embodiments, the system may further include a retractable leash device, wherein the handle and the retractable leash device are configured to be secured to one another. The elongated shaft may also include a key extending from an outer surface thereof.

In yet another aspect of the embodiments, a system for facilitating removal of an object, such as animal waste, may include an elongated shaft having a first end and a second opposing end, a handle associated with the first end, and a collection device associated with the second end. The collection device may include a first arm, a second arm forming an opening, an actuator associated with the handle, and at least one bag attachment member extending from an outer surface of the first arm. The actuator may be configured to actuate the collection device, such that animal waste is moved by the first arm into the opening of the second arm. According to another aspect, the system may further include a housing and a rod slidingly engaged within the housing and configured to pivot the first arm and the second arm relative to one another.

According to yet another aspect of the embodiments, a method for removal of animal waste may include providing a system for facilitating removal of animal waste, and providing a disposable bag to be secured to at least one bag attachment member, wherein an opening of the disposable bag at least partially corresponds to the opening of the second arm. The method may further include moving the animal waste, with the first arm, through the opening of the second arm into the disposable bag. The method may further include locking the first arm relative to the second arm. The method may also include opening and closing the collection device with an actuator.

According to still a further aspect of the embodiments, a method for removal of animal waste may include using a system for facilitating removal of animal waste. The system may include a handle and a collection device associated with the handle. The collection device may include a first arm, a second arm forming an opening, and at least one bag attachment member extending from an outer surface of at least one of the first arm and second arm. The method may include providing a detachable bag configured to be attached to the collection device. The detachable bag may include at least one hole configured to cooperate with the at least one bag attachment member. The method may further include attaching the detachable bag to the collection device by placing the at least one hole around the at least one attachment member.

The method may further include engaging animal waste with the first arm, and moving the first arm toward the second arm, such that the animal waste is conveyed through the opening in the second arm. According to another aspect, the detachable bag may be attached to the second arm such that an opening of the detachable bag corresponds to the opening of the second arm, and the method may further include moving the first arm toward the second arm, such that the animal waste is conveyed through the opening in the second arm and into the detachable bag.

Aspects and advantages of embodiments of present disclosure will be given in the following descriptions, become apparent from the following descriptions, or be learned from the practice of the embodiments of the present disclosure.

DETAILED DESCRIPTION OF EXEMPLARY EMBODIMENTS

The aforementioned and other aspects, solutions, and advantages of the presently claimed subject matter will become apparent from the following descriptions and corresponding drawings. The embodiments further clarify the presently claimed subject matter and shall not be construed to limit the scope of the present claimed subject matter.

In the following detailed description, terms of orientation such as "top," "bottom," "upper," "lower," "front," "rear," and "end" are used herein to simplify the description of the context of the exemplary embodiments. Likewise, terms of sequence, such as "first" and "second," are used to simplify the description of the exemplary embodiments. Other orientations and sequences are possible.

Also, although various embodiments disclosed in the following detailed description are addressed to collection and removal of animal waste, a person with ordinary skill in the art will appreciate that these embodiments are perfectly suited for other applications not limited to removal of animal waste.

Figure 1:
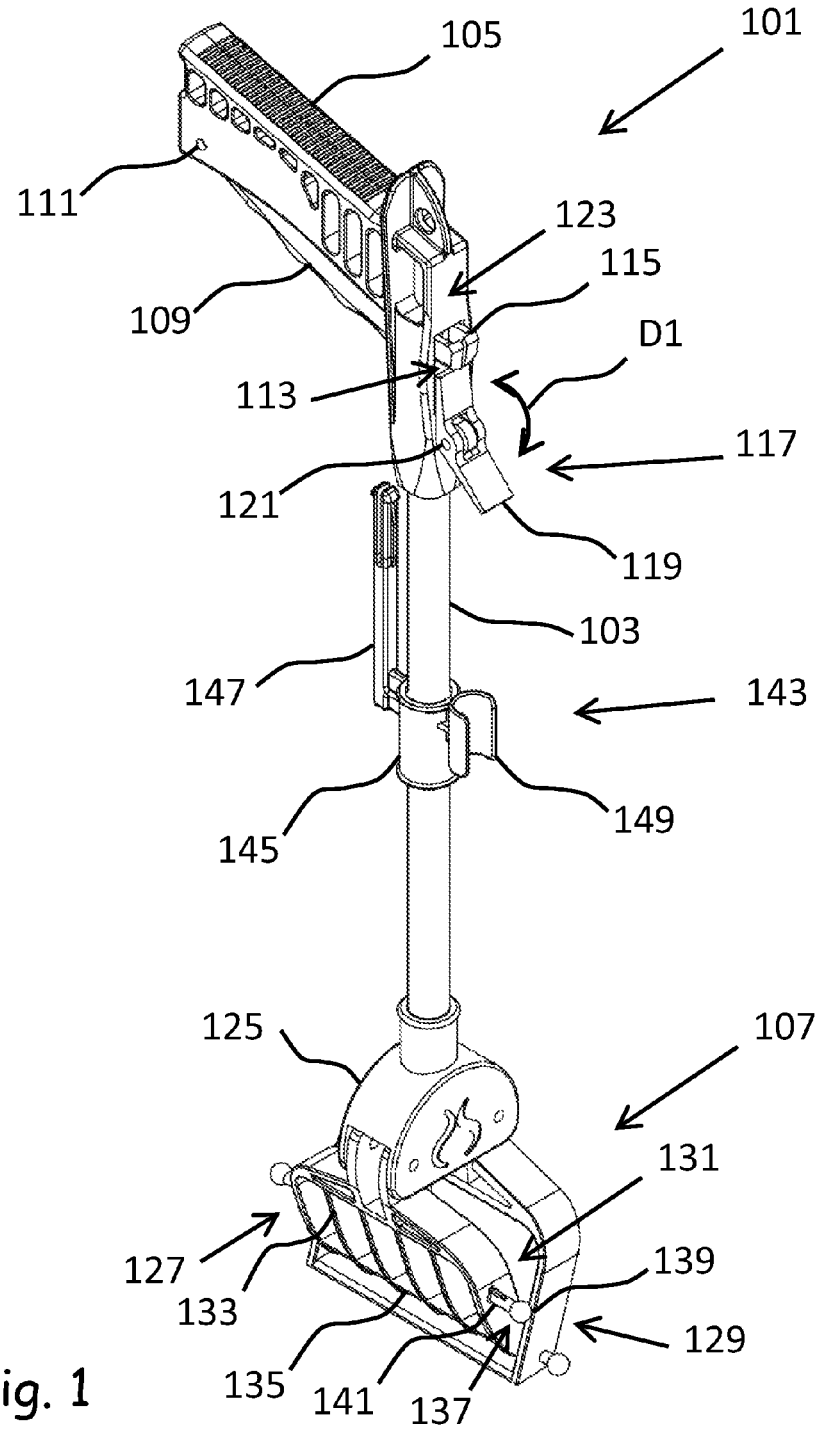
FIGS. 1 and 2 are perspective views of an exemplary embodiment of a system for removal of animal waste.
Figure 2:
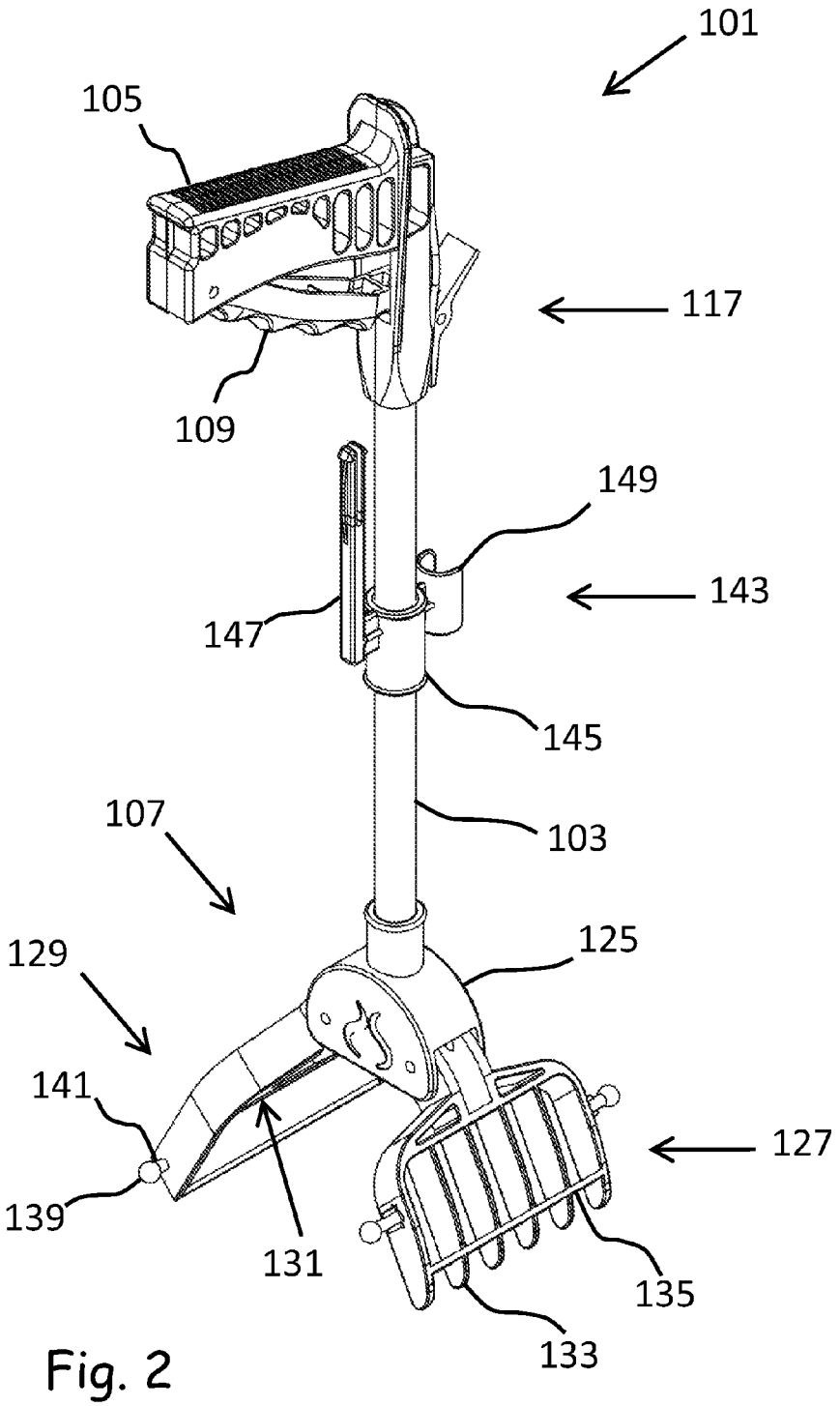

According to the exemplary embodiment shown in FIGS. 1 and 2, a system 101 for facilitating removal of animal waste may include an elongated shaft 103 associated with a handle 105 at one end and a collection device 107 at an opposing second end. During operation, the user may grab handle 105 and squeeze an actuator 109 to manually activate collection device 107. As will be explained more fully below, a biasing member (e.g., a spring) may be used to cause the collection device 107 to open and close.

In the exemplary embodiment shown in FIGS. 1 and 2, actuator 109 is pivotally attached to handle 105 about a pivot rod 111 carried by handle 105 at one end and slidingly engaged with and extending through an aperture 113 passing through the thickness of handle 105 at a second opposing end 115.

According to some embodiments, system 101 may include a latching device 117. For example, as shown in FIGS. 1 and 2, latching device 117 is associated with handle 105 and is configured to retain actuator 109 in a locked position. In the exemplary embodiment shown, latching device 117 includes a locking arm 119 that pivotally engages with handle 105 about a pivot joint 121 carried on a top surface 123 of handle 105 to move in a direction represented by arrow D1 in FIG. 1.

According to some embodiments, the latching device may allow the user to retain the actuator in a locked position, which, in turn, may secure the collection device in a closed position, thereby reducing the smell and likelihood of spilling the waste material during transit.

According to some embodiments, the latching device may be associated with the top surface of the handle, and the actuator may extend through an aperture of the handle; however, alternative embodiments of latching device are also contemplated, for example, wherein the actuator is locked in position with one or more different types of release arms. For example, the release arm can be slidingly positioned on surface 123 and/or any location on the handle that can retain the actuator in a locked position.

Exemplary collection device 107 shown in FIGS. 1 and 2 includes a housing 125 secured to shaft 103 and pivotally engaged with a first arm 127 and a second arm 129. As shown, the exemplary first arm 127 is configured to pivot into and out of an opening 131 formed by exemplary second arm 129. This exemplary feature may permit the user to scoop up the animal waste material and deposit it into opening 131.

In the exemplary embodiment shown, arm 127 includes a plurality of ribs 133 secured in position via a transverse cross bar 135. The ribs 133 may facilitate effective sweeping, grabbing, and/or scooping of animal waste in places such as, for example, grassy areas.

In the exemplary embodiment shown, collection device 107 is further provided with one or more disposable bag attachment members 137 configured to secure a bag 601 to arms 127, 129. In the exemplary embodiment shown, two attachments members 137 are secured to each arm and include a retainer 139 (e.g., a spherical knob) extending from an outer surface of the arms via a shaft 141.

Figure 5:
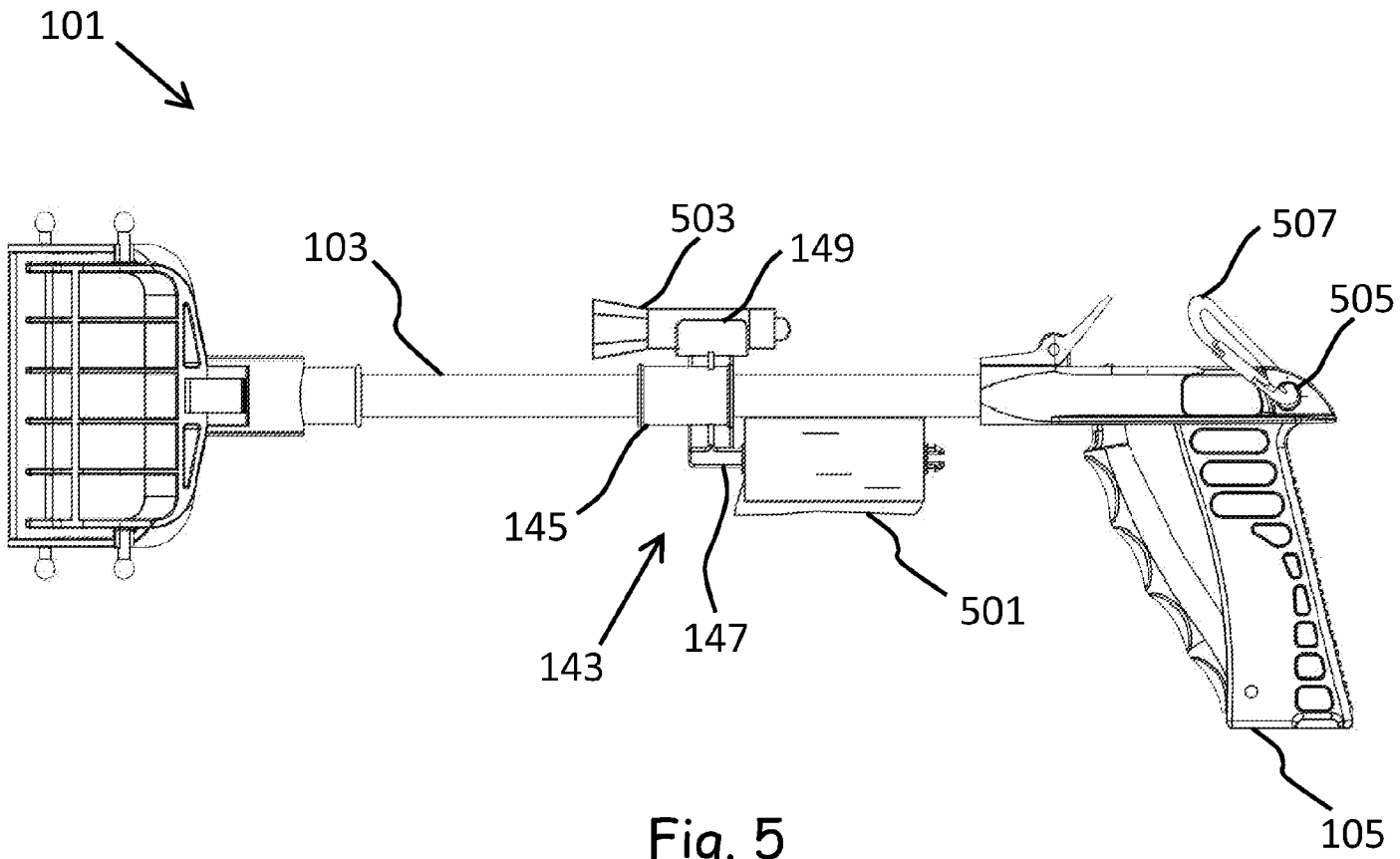
FIG. 5 is a side view of the exemplary system of FIG. 1 with additional exemplary features.

According to some embodiments, system 101 may be provided with a fastening device 143, for example, having a body 145 configured to be secured to shaft 103. In the exemplary embodiment shown, body 145 is a cylindrical sleeve that snugly fits around the periphery of shaft 103. For example, as shown in FIG. 5, fastening device 143 may be configured to carry a roll of plastic bags 501 via an elongated shaft 147 that runs relatively parallel to shaft 103, and/or a flashlight 503 via a clip 149. According to some embodiments, both shaft 147 and clip 149 are rigidly secured to body 145.

Figure 3B:
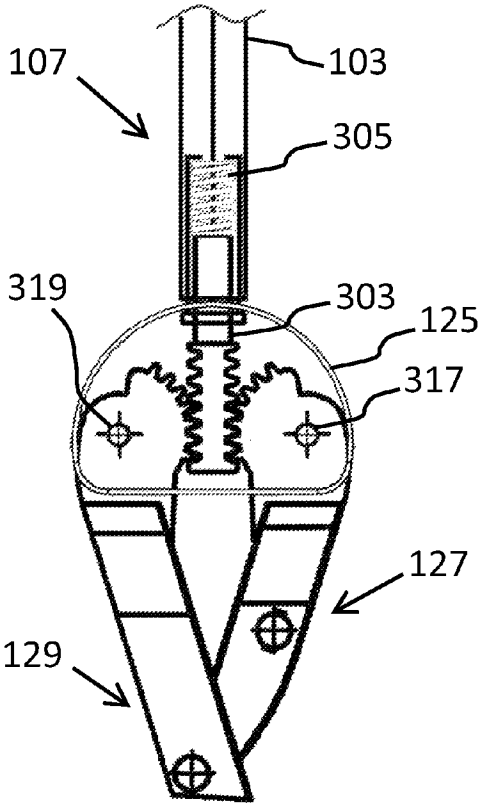
FIGS. 3A and 3B are partial front views of a portion of the exemplary system of FIG. 1.
Figure 3A:
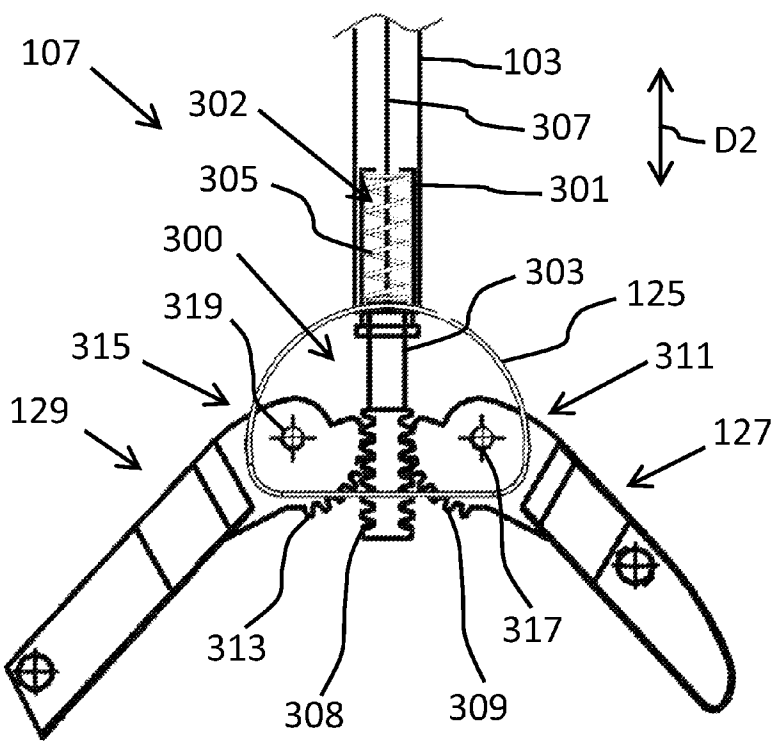

Referring now to FIGS. 3A and 3B, exemplary housing 125 is configured to be coupled to a portion of arms 127, 129 via a hollow chamber 300. Housing 125 receives an elongated shaft 301, for example, having a hollow chamber 302 configured to fit within shaft 103 and to secure housing 125 to shaft 103 in a relatively fixed position.

According to the exemplary embodiment shown, a rod 303 is configured to slidingly engage within chamber 302 and is rigidly attached to a biasing member 305 (e.g., a compression spring) disposed within chamber 302. A cable 307 extends through the shaft 103 and connects rod 303 to actuator 109. As depicted, arms 127, 129 open and close as cable 307 is pulled through shaft 103 via actuator 109, as represented with arrow D2. To achieve the opening and closing feature, rod 303 includes a plurality of teeth 308 in cooperation with a plurality of teeth 309 at an end section 311 of arm 127, and with a plurality of teeth 313 and an end section 315 of arm 129.

To achieve the arm pivoting feature, a first pivot pin 317 is carried within housing 125 and secured to arm 127 and likewise, a second pivot pin 319 is carried within housing 125 and secured to arm 129. During the exemplary operation shown in FIGS. 3A and 3B, the cable 307 is pulled through shaft 103, the rod 303 slides within housing 302, the biasing member 305 compresses, and the arms 127, 129 pivot about the respective pins 317, 319.

Figure 4A:
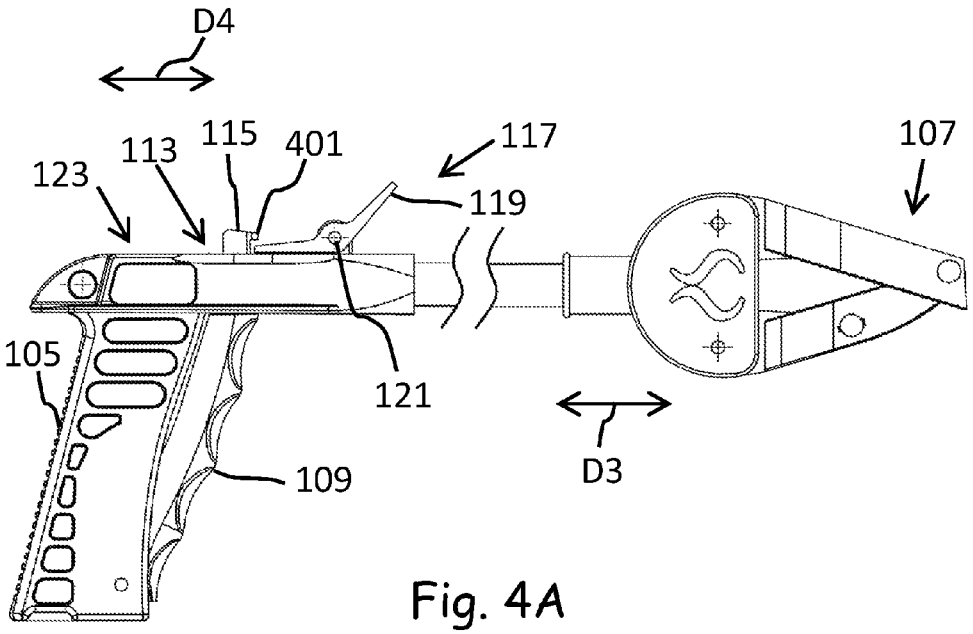
FIGS. 4A and 4B are partial side views of the exemplary system of FIG. 1.
Figure 4B:
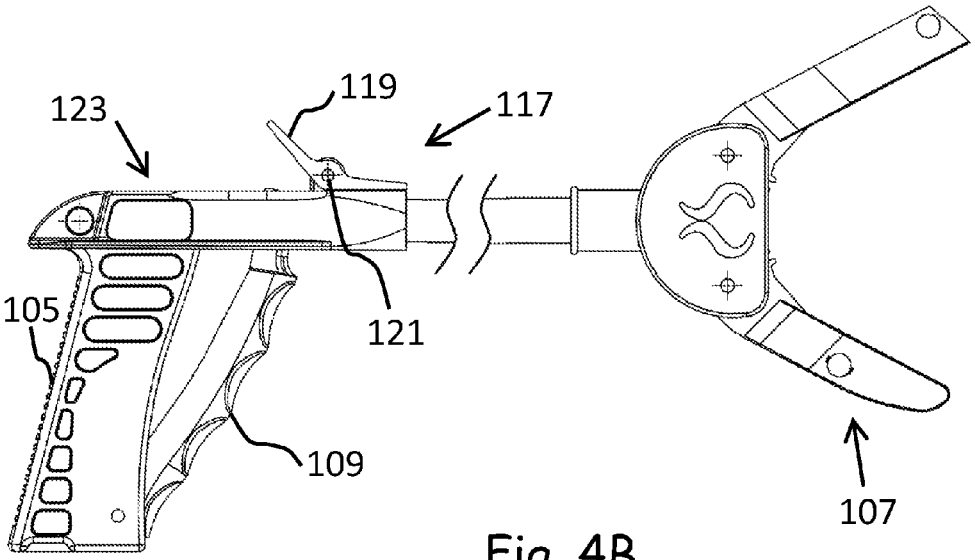

Side views of exemplary system 101 are shown in FIGS. 4A and 4B to further illustrate exemplary features of latching device 117. As discussed above, exemplary latching device 117 includes a locking arm 119 that pivotally moves with respect to handle 105 about a pivot joint 121 on surface 123 between latched and unlatched positions. As further illustrated in FIGS. 4A and 4B, the actuator end 115 is configured to extend through aperture 113 and includes a ridge 401 that engages with arm 119 to hold the collection device 107 in a closed position. It should be understood that biasing member 305 exerts a force in direction D3 against the actuator 109 via cable 307 extending through shaft 103. As such, a biasing force (e.g., a spring-loaded force) is exerted against ridge 401 to engage with arm 119 while in the latched position. To unlatch actuator 109, the user merely squeezes the actuator 109 in direction D4, which in turn allows arm 119 to pivot about pin 121, as depicted in FIG. 4B.

FIG. 5 is a side view of an exemplary embodiment of system 101 and depicts an optional roll of plastic bags 501 and an optional flashlight 503 secured to the shaft 103 via fastening device 143. System 101 can also include a hole 505 extending through the thickness of handle 105 and configured to receive a fastening device, such as, for example, a carabiner 507 or other suitable quick-release device.

FIGS. 6A-6D illustrate partial views of an exemplary system 101 operably associated with a detachable bag 601 configured to be releasably attached to collection device 107, for example, via one or more holes 603 adapted to engage with attachment members 137. In the exemplary embodiment shown, bag 601 is composed of an elastomeric material, which may be biodegradable and/or scented.

Figure 6D:
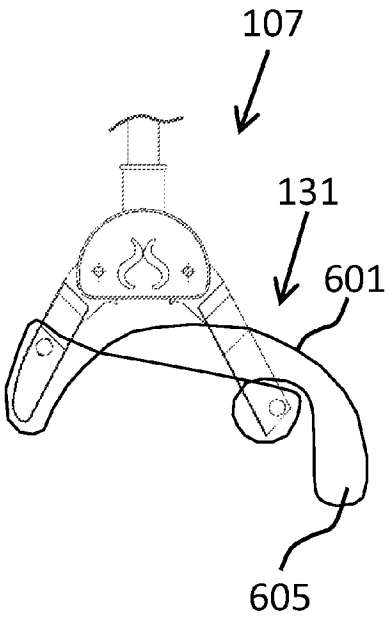
FIGS. 6A, 6B, 6C, and 6D are partial views of a portion of the exemplary system of FIG. 1 used according to an exemplary method.
Figure 6C:
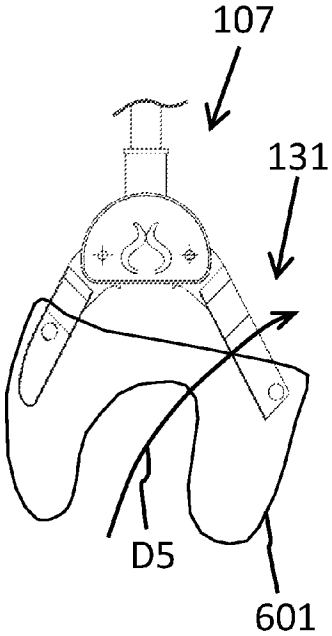
Figure 6B:
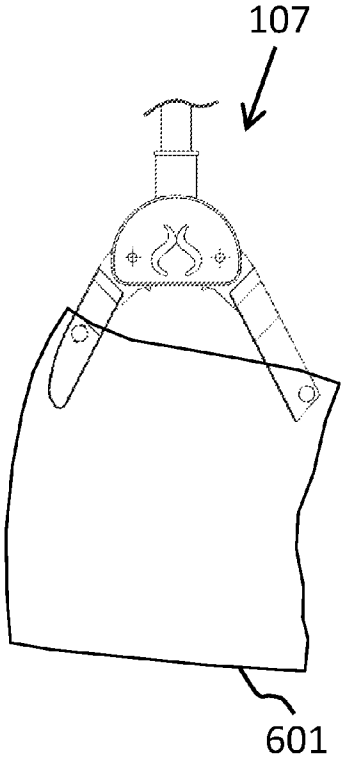
Figure 6A:
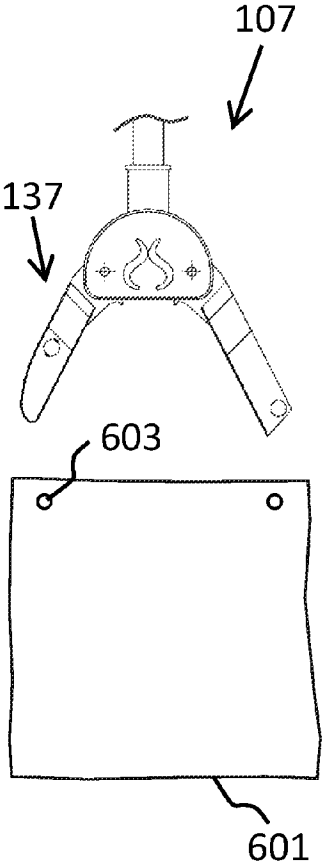

According to one exemplary method, the method to secure bag 601 to collection device 107 includes securing the bag 601 to both arms 127, 129 by placing the holes 603 over the attachment members 137, as shown in FIGS. 6A-6D. Only two holes 603 of bag 601 are shown in FIGS. 6A-6B for the sake of clarity. Thereafter, the bag 601 is passed through opening 131 of arm 129, as shown in FIG. 6C and indicated by arrow D5. In FIG. 6D, bag 601 is shown passing through opening 131 and ready for use. In this exemplary configuration, the animal waste material (not shown) can be scooped via arm 127 and passed through opening 131, so that it is received within a cavity 605 formed by bag 601. As discussed above, the arms may be closed and locked in a closed position thereafter via the latching device. Finally, bag 601 may be quickly and easily disengaged from attachment members 137 to dispose of the animal waste material and bag 601.

In the exemplary embodiment shown, bag 601 simply includes four holes that extend through the thickness of the bag material and are selectively dimensioned and sized to fit around retainer 139. Although contemplated using holes and an attachment member to secure the bag to the collection device, it should be appreciated that alternative embodiments could utilize other means to secure the bag to the collection device, including, clips, snaps, buttons, hook-loop, and other suitable fastening systems.

Figure 7:
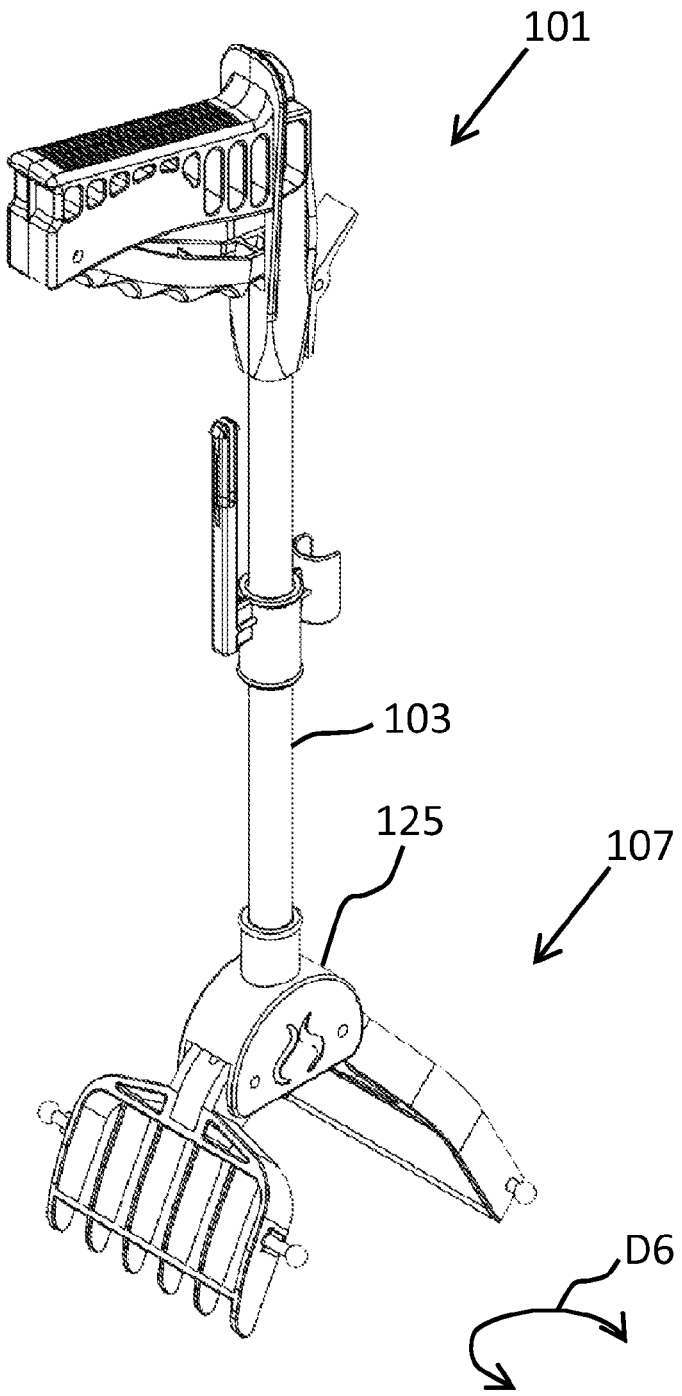
FIG. 7 is a perspective view of another exemplary embodiment of a system for facilitating removal of animal waste.

In FIG. 7, an alternative embodiment of system 101 is shown. As depicted, the collection device 107 may be configured to rotate in the directions D6 in either a fixed or an interchangeable position. This feature may provide the user with a better view of the cleanup process as the arms are manipulated to collect the animal waste.

Figure 8A:
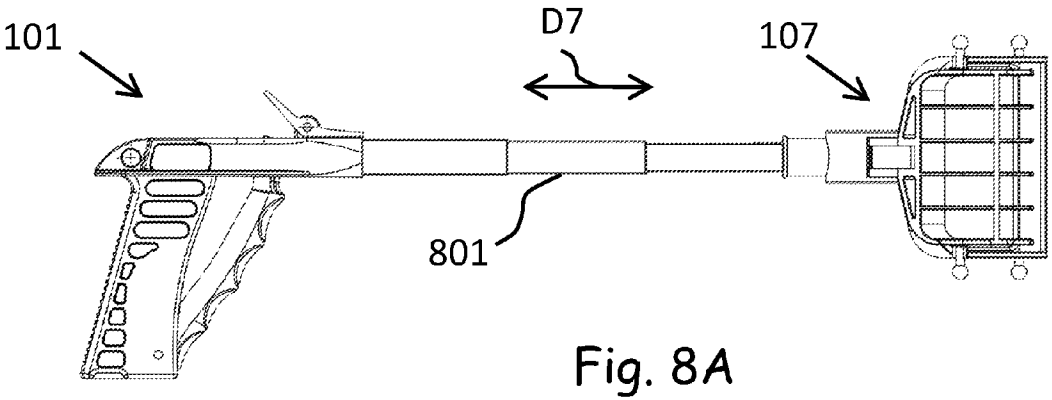
FIGS. 8A and 8B are side views of another exemplary embodiment of a system for facilitating removal of animal waste.
Figure 8B:
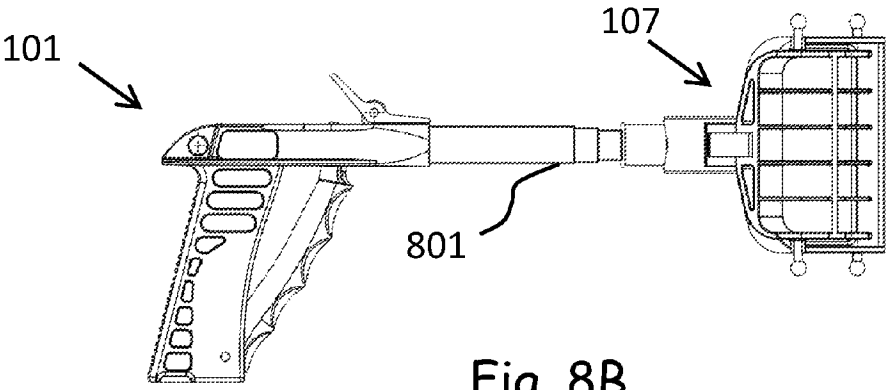

In FIGS. 8A and 8B, an alternative embodiment of system 101 is shown. In the exemplary embodiment shown, system 101 includes a telescoping shaft 801, which in turn, allows the user to selectively choose the overall length of the shaft, as depicted with arrow D7. This feature accommodates users of different heights. For example, a shorter shaft may be more desirable to shorter users, and a longer shaft may be more desirable for taller users.

Figure 9A:
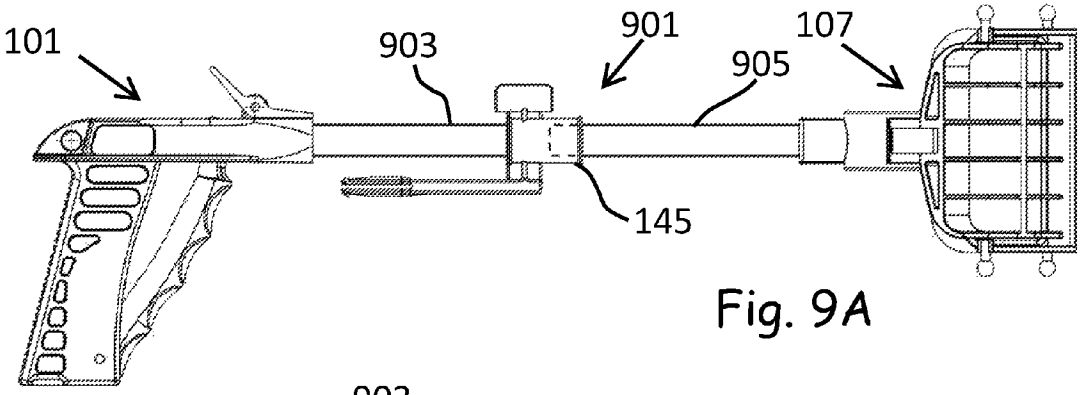
FIGS. 9A and 9B are side views of another exemplary embodiment of a system for facilitating removal of animal waste.
Figure 9B:
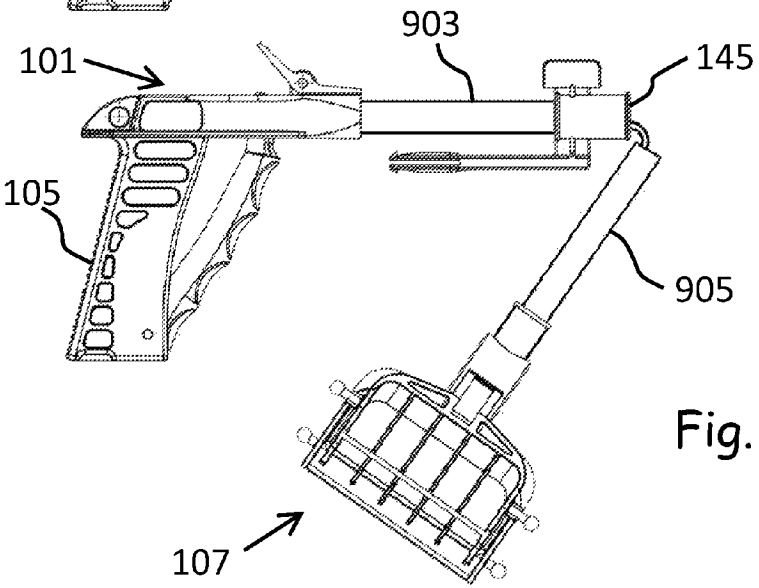

In FIGS. 9A and 9B, an alternative embodiment of system 101 is shown. In the exemplary embodiment shown, system 101 includes a shaft 901 having two members 903 and 905 pivotally secured to each other about connection 145. This feature allows the user to reduce the overall length of shaft 901, which may be desirable during transit and storage. For example, when folded, exemplary system 101 may fit in a small backpack or a carrying case.

Figures 10A, 10B:
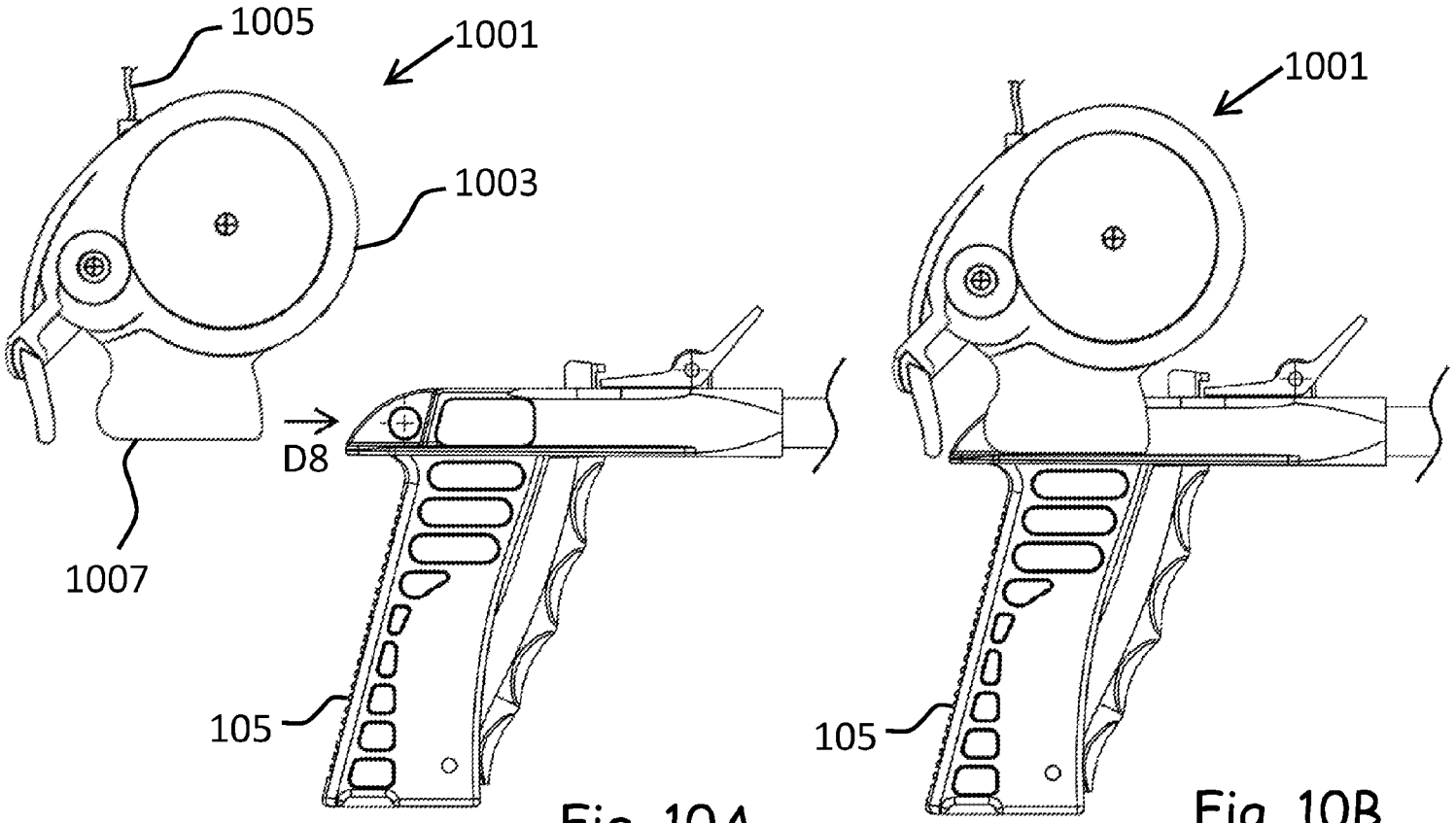
FIGS. 10A and 10B are side views of another exemplary embodiment of a system for facilitating removal of animal waste used with an additional exemplary feature.

In FIGS. 10A and 10B, an alternative embodiment of system 101 is shown. In the exemplary embodiment shown, system 101 may be coupled to a retractable leash device 1001 to removably attach to handle 105. In the exemplary embodiment shown, device 1001 includes a housing 1003 having a spool therein (not shown) for playing out and retracting leash 1005. A base portion 1007 may be attached to housing 1003 and configured to secure housing 1003 to handle 105. In the exemplary embodiment shown, base 1007 slidingly engages with handle 105 and may be secured to the handle 105 via one or more different types of fasteners (not shown). During use, the user may pull leash 1005 from housing 1003, which in turn will allow leash 1005 to play out from the self-winding spool.

Figure 11:
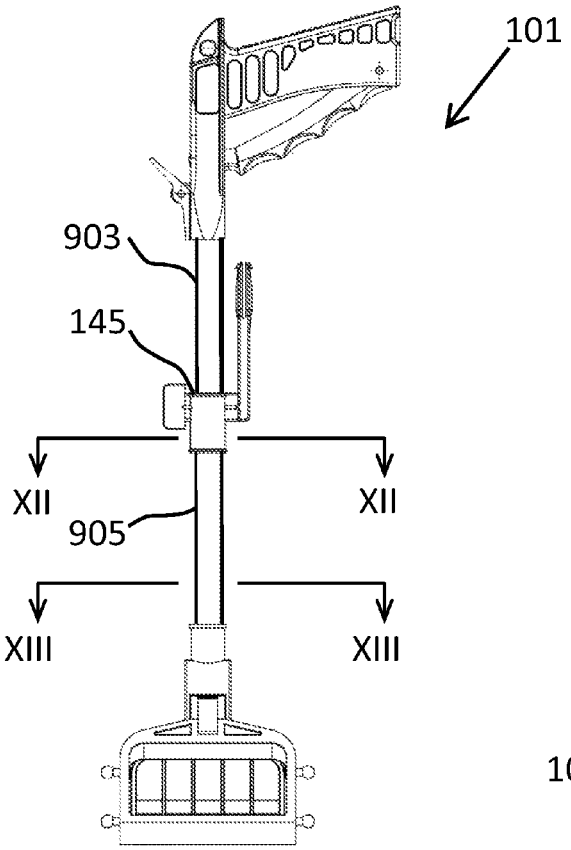
FIG. 11 is a side view of another exemplary embodiment of a system for facilitating removal of animal waste used with an additional exemplary feature.
Figure 12:
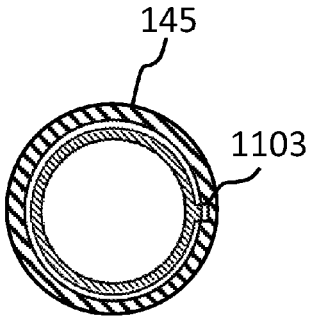
FIGS. 12 and 13 are cross-sectional views of portions of the exemplary embodiment shown in FIG. 11.
Figure 13:
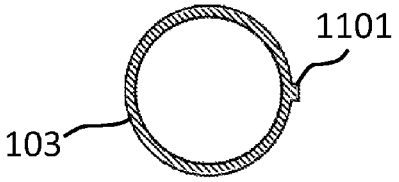

Referring now to FIGS. 11-13, an alternative embodiment of system 101 is depicted. It should be understood that according to some embodiments having two shafts 903, 905, shafts 903, 905 may tend to twist relative to one another during use. As such, according to some embodiments, system 101 may be provided with a key 1101 that may extend at least a portion of the longitudinal length of either one or both of shafts 903, 905 and is received within a keyway 1103 extending partially within the thickness of connection 145, handle 105, and/or housing 125. It will be appreciated that according to some embodiments, the key may provide effective means to prevent the undesired twisting effect of the shaft during use In the preceding specification, the claimed subject matter has been described with reference to specific exemplary embodiments. It will, however, be evident that various modifications and changes may be made without departing from the broader spirit and scope of the claimed subject matter as set forth in the claims that follow. The specification and drawings are accordingly to be regarded as illustrative rather than restrictive. Other embodiments of the claimed subject matter may be apparent to those skilled in the art from consideration of the specification and practice of the claimed subject matter disclosed herein.

What is claimed is:

1. A system for facilitating removal of animal waste, the system comprising:

an elongated shaft having a first end and a second end;

a handle associated with the first end, the handle having an aperture;

a collection device associated with the second end, the collection device being configured to collect animal waste;

an actuator associated with the handle and operably coupled with the collection device, the actuator is configured to actuate the collection device into at least one of an opening position prior to an animal waste collection and a closed position that substantially enclose animal waste in the collection device, the actuator having an end configured to extend through the aperture of the handle; and a latching device associated with the handle, the latching device being configured to retain the collection device in at least one of the opening position and the closed position, the latching device being configured to pivotally attach to a top surface of the handle and configured to engage with the end of the actuator extending through the handle.

2. The system of claim 1, further comprising a cable coupled to the actuator and coupled to the collection device, wherein the cable extends substantially the length of the elongated shaft.

3. The system of claim 1, wherein the elongated shaft comprises a first shaft section removably coupled to a second shaft section.

4. The system of claim 1, wherein the elongated shaft is configured to be selectively extended and retracted telescopically.

5. The system of claim 1, further comprising a housing coupled to the second end of the elongated shaft and to the collection device, wherein the housing is rotatable relative to the elongated shaft.

6. The system of claim 1, wherein the collection device comprises a first arm and a second arm, wherein at least one of the first arm and the second arm is configured to pivot relative to each other, and wherein the first arm is configured to convey animal waste towards the second arm.

7. The system of claim 6, further comprising a cable coupled to the actuator and associated with the collection device, wherein the actuator is configured to cause the at least one of the first arm and the second arm to pivot via the cable.

8. The system of claim 6, wherein the first arm comprises a plurality of ribs, and the second arm defines an opening.

9. The system of claim 6, wherein the at least one of the first arm and the second arm comprises at least one bag attachment member configured to secure a detachable bag to the collection device.

10. The system of claim 9, wherein the at least one bag attachment member extends from an outer surface of the first arm.

11. The system of claim 9, further comprising a detachable bag, wherein the detachable bag comprises at least one hole configured to receive the bag attachment member.

12. The system of claim 11, wherein the at least one attachment member comprises a shaft and a retainer, and wherein the at least one hole is configured to be placed over the retainer and around the shaft.

13. The system of claim 12, wherein the first arm comprises a plurality of attachment members, wherein the second arm comprises a plurality of attachment members, and wherein the detachable bag comprises a plurality of holes configured to receive at least two attachment members from each of the first arm and the second arm.

14. The system of claim 1, further comprising a retractable leash device, wherein the handle and the retractable leash device are configured to be secured to one another.

15. The system of claim 1, wherein the elongated shaft comprises a key extending from an outer surface thereof.

16. A method for removal of animal waste, the method comprising:

providing a system for facilitating removal of animal waste, the system comprising:

an elongated shaft having a first end and a second opposing end;

a handle associated with the first end;

an actuator associated with the handle; and a collection device associated with the second end, the collection device comprising:

a first arm having a plurality of ribs;

a second arm forming an opening;

a first bag attachment member extending from an outer surface of the first arm; and a second bag attachment member extending from an outer surface of the second arm;

wherein the actuator is configured to actuate the collection device, such that animal waste is moved by the first arm into the opening of the second arm;

providing a disposable bag to be secured to the at least one bag attachment member, wherein an opening of the disposable bag at least partially corresponds to the opening of the second arm;

moving the animal waste, with the first arm, through the opening of the second arm into the disposable bag; and locking the first arm relative to the second arm.

17. The method of claim 16, further comprising opening and closing the collection device with the actuator.

18. The method of claim 16, further comprising:

engaging animal waste with the first arm; and moving the first arm toward the second arm, such that the animal waste is conveyed through the opening in the second arm.

19. The method of claim 18, wherein the disposable bag is attached to the second arm such that an opening of the disposable bag corresponds to the opening of the second arm, and wherein the method further moving the first arm toward the second arm, such that the animal waste is conveyed through the opening in the second arm and into the disposable bag.

* * * * *